US008640412B2

(12) United States Patent
Kato

(10) Patent No.: US 8,640,412 B2
(45) Date of Patent: Feb. 4, 2014

(54) WALL STRUCTURE USING BEARING WALL PANEL FOR WOODEN BUILDING AND CONSTRUCTION METHOD THEREOF

(75) Inventor: Teruyuki Kato, Nagoya (JP)

(73) Assignee: Nichiha Corporation, Nagoya-Shi (JP)

( * ) Notice: Subject to any disclaimer, the term of this patent is extended or adjusted under 35 U.S.C. 154(b) by 215 days.

(21) Appl. No.: 13/166,271

(22) Filed: Jun. 22, 2011

(65) Prior Publication Data

US 2012/0017537 A1 Jan. 26, 2012

(30) Foreign Application Priority Data

Jul. 20, 2010 (JP) ..... 2010-162607

(51) Int. Cl.
*E04B 1/70* (2006.01)

(52) U.S. Cl.
USPC ..... 52/302.3

(58) Field of Classification Search
USPC ..... 52/198, 302.1, 302.3, 481.1
See application file for complete search history.

(56) References Cited

U.S. PATENT DOCUMENTS

| | | | | | |
|---|---|---|---|---|---|
| 2,118,237 | A * | 5/1938 | Games et al. | 52/481.1 |
| 4,031,681 | A * | 6/1977 | Charniga | 52/408 |
| 4,888,933 | A * | 12/1989 | Guomundsson et al. | 52/779 |
| 5,165,212 | A * | 11/1992 | Arnold | 52/481.1 |
| 6,148,583 | A * | 11/2000 | Hardy | 52/693 |
| 6,212,849 | B1 * | 4/2001 | Pellock | 52/693 |
| 6,279,284 | B1 * | 8/2001 | Moras | 52/408 |
| 6,594,964 | B2 * | 7/2003 | Charland | 52/302.1 |
| 6,792,725 | B1 * | 9/2004 | Rutherford | 52/209 |
| 7,617,638 | B1 * | 11/2009 | Slama et al. | 52/95 |
| 2001/0002529 | A1 * | 6/2001 | Commins et al. | 52/481.1 |
| 2001/0004821 | A1 * | 6/2001 | Kaneko et al. | 52/483.1 |
| 2002/0002806 | A1 * | 1/2002 | Commins et al. | 52/481.1 |
| 2002/0108332 | A1 * | 8/2002 | Timmerman et al. | 52/293.3 |
| 2003/0192279 | A1 * | 10/2003 | Hughart | 52/481.1 |
| 2008/0086967 | A1 * | 4/2008 | Namba et al. | 52/414 |

FOREIGN PATENT DOCUMENTS

| | | | | |
|---|---|---|---|---|
| EP | 0468949 | * | 6/1991 | |
| JP | 55-132839 | A | 10/1980 | |
| JP | 03180643 | A * | 8/1991 | E04B 1/74 |
| JP | 09-250192 | A | 9/1997 | |
| JP | 10-152922 | A | 6/1998 | |
| JP | 10-280580 | A | 10/1998 | |
| JP | 11-071828 | A | 3/1999 | |
| JP | 2001-090184 | A | 4/2001 | |
| JP | 3129745 | U | 3/2007 | |

* cited by examiner

*Primary Examiner* — Christine T Cajilig
(74) *Attorney, Agent, or Firm* — Birch, Stewart, Kolasch & Birch, LLP

(57) ABSTRACT

In building a house, it is necessary to arrange bearing walls and non-bearing walls in a well-balanced manner. However, in the case where a bearing wall is configured by fixing a plate-like body such as a bearing wall panel to the exterior-side face of a structural frame member formed by assembling horizontal members and pillar members into the shape of a square frame, the surface of the bearing wall panel protrudes from the face of the structural frame member on the exterior side by a distance corresponding to the thickness of the bearing wall panel. Thus, the exterior-side face of the bearing wall in which the bearing wall panel is provided is not flush with the exterior-side face of the non-bearing wall in which the bearing wall panel is not provided, and so there is a step. Accordingly, processing of the base during attachment of an exterior building material has been necessary. Furthermore, there has been a problem that in the case where the condition of the framework is to be inspected after building, the inspection cannot be performed unless the bearing wall panel is removed.

Receiving members are fixed to inner side faces enclosed by structural members including pillars, studs, and horizontal members, of a building so as to allow a face of a bearing wall panel on the exterior side to be flush with faces of the structural members on the exterior side and a face of an adjacent non-bearing wall on the exterior side.

4 Claims, 26 Drawing Sheets

PRIOR ART

PRIOR ART

PRIOR ART

PRIOR ART

PRIOR ART

PRIOR ART

PRIOR ART

PRIOR ART

PRIOR ART

PRIOR ART

WALL STRUCTURE USING BEARING WALL PANEL FOR WOODEN BUILDING AND CONSTRUCTION METHOD THEREOF

BACKGROUND OF THE INVENTION

1. Field of the Invention

The present invention relates to a wall structure using a bearing wall panel for houses built by a timber framework construction method.

2. Description of Related Art

Conventionally, it is prescribed that when designing the structure of a building, the design be such that the building as a whole is safe in terms of structural resistance to its own weight, live load, accumulated snow, wind pressure, earth pressure, and water pressure; and earthquakes and other vibrations and impacts by effectively arranging pillars, beams, floors, walls, and the like so as to withstand certain levels of wind force and seismic force.

Moreover, it is prescribed that in a building in which walls, pillars, and horizontal members are made of wood, frameworks having a wall or a brace be arranged in a well-balanced manner in a span direction and a ridge direction on each floor for the safety against horizontal forces in all directions.

In regard to installation of a brace, if connecting portions at both ends of the brace loosen, the brace fails to function as a brace, and in the case where the brace is used in a wall that withstands a large horizontal load, design and construction of the connecting portions are complicated. Therefore, in order to ensure that the construction is performed properly, a method in which, instead of the brace or in combination with the brace, a bearing wall panel is nailed to the frameworks for reinforcement has been employed.

In a building, a wall that has the capability to resist a horizontal load "i.e. a lateral force" such as that from an earthquake or wind is referred to as a bearing wall, and a wall that is not structurally fixed is referred to as a non-bearing wall.

Moreover, in a wooden building, a wall that resembles the bearing wall but that is imperfectly fixed and has a low resistance "e.g., a partition wall or the like" is referred to as a semi-bearing wall.

Since connecting portions of a wooden building are easily rotated, it is not possible for the building to resist the horizontal load such as that from an earthquake or wind only with pillars and beams. For this reason, it is required to provide a predetermined amount of bearing walls on each floor. A building with many bearing walls has excellent resistance to earthquakes and wind. Furthermore, the earthquake resistance can be enhanced when various members of the building are properly bound together with metal fittings.

The bearing wall can be produced by attaching a brace to a framework with metal fittings or securing a bearing wall panel composed of a board such as structural plywood to a framework with predetermined nails. On the other hand, a wall in which only a moisture-permeable waterproof sheet or a siding is attached to a framework is not a bearing wall.

An example of a numerical value representing the performance of a bearing wall is a wall strength factor. A wall strength factor of 1.0 times indicates the ability to resist a horizontal load "i.e. a lateral force" of 1.96 KN per meter of wall length. The higher this value, the higher the performance and the larger the horizontal load the bearing wall can withstand. With respect to the timber framework construction method, Article 46 of the Order for Enforcement of the Building Standard Law and the Notification No. 1100 of the Ministry of Construction prescribe that the wall strength factor for several specifications of bearing walls be fall within a range of 0.1 to 5.0.

In regard to the earthquake resistance of a house, a seismic force acts on the center of gravity of the house, and the house deforms in a horizontal direction and also rotates on the center of rigidity. Therefore, if the center of gravity and the center of rigidity are too far from each other, excessive deformation occurs in part of the house, resulting in damage to structural members. As a result, load-bearing capacity of the house decreases, and the load of the seismic force is concentrated on the other portions, which may lead to collapse of the house in the worst case. Therefore, it is preferable that the center of gravity and the center of rigidity of the house coincide with each other.

Here, the center of gravity is the center of a planar shape of a building and is the center of the weight of the building. The center of rigidity is the center of forces that counteract a horizontal force and is the center of rigidities of bearing walls. The center of rigidity can be determined from horizontal rigidities of earthquake-resistant elements such as bearing walls and their coordinates. Furthermore, a discrepancy between the center of gravity and the center of rigidity of a building is defined by an eccentric distance and an eccentricity. The eccentricity that can be calculated from the eccentric distance is the ratio of the distance between the center of gravity and the center of rigidity to torsional resistance.

The center of gravity on each floor of the building can be calculated from an axial force due to sustained loading that occurs in principal members in terms of structural resistance, such as pillars that support vertical loads, and coordinates X, Y of those members. However, in the case of the timber framework construction method, it is supposed that the centroid of a plane coincides with the center of gravity assuming that the dead load and the live load on each floor are uniformly distributed in a plane and there is no imbalance. The center of rigidity can be calculated from horizontal rigidities of the earthquake-resistant elements such as bearing walls in each direction of calculation and their coordinates. Here, the horizontal rigidity can be calculated from the actual wall length and the wall strength factor, and the eccentricity can be calculated from the above-described center of gravity and center of rigidity.

Even when sufficient bearing walls are secured, there is a risk that the building may be deformed or twisted when an earthquake occurs, leading to collapse of the building, unless the bearing walls are arranged in a well-balanced manner without being concentrated on one side of the building. Generally, a building having many bearing walls in the vicinity of the periphery thereof is resistant to torsion. On the other hand, a so-called U-shaped arrangement in which, for example, the north side is fully constituted by bearing walls and the south side is fully constituted by openings is susceptible to torsion and can easily lead to the collapse when an earthquake occurs.

An example of a value representing the imbalance of bearing walls is the eccentricity. The larger the value of eccentricity, the larger the imbalance of bearing walls it represents. In the Notification No. 1352 of the Ministry of Construction in 2000, it is prescribed that the eccentricity of a wooden building specified by Article 46, Section 4 of the Order for Enforcement of the Building Standard Law should be 0.3 or less, and generally, it is said that a house whose eccentricity is 0.15 or less is particularly preferable.

As described above, in order to build an earthquake-proof building, it is necessary to provide a bearing wall. Conventionally, in the case of building a house using the timber framework construction method, a plate-like body referred to as a bearing wall panel has been used instead of a brace or in combination with a brace to form a bearing wall that counteracts a force acting in the horizontal direction such as that from an earthquake, wind pressure, or the like.

BACKGROUND ART

JP 2001-90184A
JP 11-71828A
JP 10-152922A
JP 3129745U
JP 10-280580A
JP 55-132839A
JP 9-250192A

SUMMARY OF THE INVENTION

Conventionally, it has been known that in the case of building a house using the timber framework construction method, a bearing wall in which a bearing wall panel is nailed to a framework instead of a brace provides greater ease of construction than a bearing wall in which a brace is used.

In order to increase the earthquake resistance, it is desirable that the bearing walls are arranged on the entire periphery of the house. However, openings such as a window, a front door, and other entrances are necessary for a person to reside in the house, and so there are non-bearing walls as places where the bearing walls cannot be provided. Therefore, when designing a house, it is necessary to arrange the bearing walls and the non-bearing walls in a well-balanced manner. For this reason, the Building Standard Law provides the eccentricity as an indicator for arranging the bearing walls and the non-bearing walls in a well-balanced manner in order to keep good earthquake resistance of a house.

In the case where the bearing wall is configured by fixing an outer plate-like body such as a bearing wall panel to an outer face of a structural frame member formed by assembling horizontal members and pillar members into the shape of a square frame, the surface of the bearing wall panel protrudes from the outer face of the structural frame member by a distance corresponding to the thickness of the bearing wall panel. Thus, irregularities occur between the bearing wall in which the bearing wall panel is provided and the non-bearing wall in which the bearing wall panel is not provided. When attaching the exterior building material, a base for the exterior building material should not have unevenness, and therefore an extra process for smoothing the base has conventionally been necessary.

It is also possible to provide a non-bearing wall panel that is not a bearing wall panel but has the same thickness as the bearing wall panel in the non-bearing wall in order to prevent the occurrence of unevenness in the above-described base. However, in this case, an extra material cost or construction cost has been required due to the use of the non-bearing wall panel, which is not necessary.

The present invention has been made in view of problems as described above, and it is an object thereof to provide a wall structure in which even though a bearing wall panel is used in a bearing wall, the surface of the bearing wall panel does not protrude from outer faces of framework structural members and an adjacent non-bearing wall on the exterior side, and therefore the necessity of adjusting unevenness during subsequent attachment of an exterior building material can be eliminated, the bearing wall can sufficiently exhibit the function of a bearing wall, and the bearing wall panel can be accurately and efficiently attached to the structural frame member.

There is another problem as follows. The bearing wall composed of the bearing wall panel is generally constructed using a stud wall framing finished on both side construction method because of the convenience of construction. However, there has been a problem in that with the bearing wall panel attached to the framework with nails or the like using the stud wall framing finished on both side construction method, when the condition of the framework is to be inspected for maintenance after building, the condition of the pillars and the horizontal members, which are the most important structural members for the timber framework construction method, cannot be inspected without removing the bearing wall panel.

In order to continue to use a wooden house for a long period of time, periodic inspections of the structural members, in particular, the pillars and the sills, of the house are important. In order to easily realize the inspections of the pillars and the sills, there has been a demand for a bearing wall structure in which the bearing wall panel does not cover the structural members, thereby allowing easy inspection of the structural members.

A first aspect of the invention is a wall structure for a wooden building, the wall structure including a bearing wall, a non-bearing wall, a furring strip, and an exterior building material, wherein in the bearing wall in which receiving members are fixed to inner side faces enclosed by structural members including pillars and horizontal members of a wooden building and a bearing wall panel is fixed to an exterior side of the receiving members, a face of the bearing wall panel on the exterior side is flush with faces of the structural members on the exterior side and a face of an adjacent non-bearing wall on the exterior side.

According to the first aspect of the invention, in the bearing wall, the receiving members that have been firmly integrated with the structural members with fixing members based on predetermined specifications and that contribute to the structure of the bearing wall are fixed to the inner side faces of the structural members, and the bearing wall panel is fixed to the exterior side of the receiving members. In this bearing wall, the receiving members are fixed at positions set back from an external surface of the structural members on the exterior side by a distance corresponding to the thickness of the bearing wall panel so as to prevent the face of the bearing wall panel on the exterior side from protruding to the exterior side from the faces of the structural members on the exterior side.

The bearing wall panel is placed in such a position that end portions of the bearing wall panel are on the inside of the inner side faces of the structural members, and fixed to the receiving members using fixing members such as nails in the vicinity of peripheral end portions of the bearing wall panel.

In the case where it is desired to achieve good air permeability inside the bearing wall, when vent portions penetrating the receiving members from an interior side to the exterior side are provided in the receiving members fixed to the structural members, the air permeability of the receiving members improves.

Furthermore, when the bearing wall panel is fixed to the receiving members with a gap between the structural members and end portions of the bearing wall panel so as not to block openings of the vent portions of the receiving members, the air permeability of the bearing wall is further improved.

Since the bearing wall panel is fixed to the receiving members in the vicinity of the peripheral end portions of the bearing wall panel, the bearing wall panel and the receiving members are in an integrated state in which they are integrated. Moreover, the fixing members for fixing the receiving members to the structural members are made stronger than the fixing members, such as nails, for fixing the bearing wall panel to the receiving members. Thus, even when a shear force acts on the fixing members for fixing the receiving members, plane shear deformation of the structural members, the receiving members, and the fixing members is small, and therefore the receiving members can be regarded as being completely integrated with the structural members. As a result, the structural members, the receiving members, and the bearing wall panel are brought into an integrated state. It should be noted that the spacing of the fixing members for fixing the bearing wall panel to the receiving members and the spacing of the fixing members for fixing the receiving members to the structural members are set in accordance with the required wall strength factor.

When the vent portions are provided in the receiving members fixed to the structural members, ventilation inside the bearing wall is ensured. Thus, even if external water intrudes into the inside of the bearing wall or water condensation occurs, the water or condensed water is discharged and the inside of the bearing wall is quickly dried by ventilation. Therefore, it is possible to improve the durability of the structural members. Moreover, the necessity to perform cutting of the receiving members during construction is eliminated by forming the vent portions in the receiving members beforehand.

Therefore, overall construction of the wall is facilitated, and thus construction time and cost can be reduced. Also, a bearing wall having a high wall strength factor can be obtained while improving the durability of the structural members by maintaining the air permeability inside the wall.

Materials accepted by Article 46 of the Order for Enforcement of the Building Standard Law, such as structural plywood, particle board, oriented strand board (OSB), hardboard, hard wood fiber reinforced board, gypsum board, pulp cement flat sheet, sheathing board, and others, can be used as the bearing wall panel, and a wall in which such a material is fixed to the structural members using an accepted method serves as the bearing wall.

After the bearing wall panel has been attached to the structural members, waterproof paper such as a moisture-permeable waterproof sheet is provided in a stretched manner on the surface of the bearing wall panel on the exterior side, and then furring strips are placed on top of the waterproof paper and fastened to the building frame including the pillars and the horizontal members via the waterproof paper. Subsequently, the exterior building material is fastened to the furring strips with nails or fastening metal fittings. A vent layer is formed between the exterior building material and the bearing wall panel by interposing the furring strips between them.

Even if moisture on the interior side intrudes into the inside of the bearing wall through an interior building material, the moisture passes through the bearing wall panel if the bearing wall panel is a plate-like body having moisture permeability or passes through the vent portions provided in the receiving members if the bearing wall panel is a less moisture-permeable plate-like body, and is released or allowed to penetrate to the exterior building material side through the waterproof paper. As a result, the moisture on the interior side is released into the vent layer between the exterior building material and the bearing wall panel.

Furthermore, since there is no step between the bearing wall and the non-bearing wall, the necessity of processing the base, for example, using a wood strip or the like for eliminating the step or unevenness between the bearing wall and the non-bearing wall or using furring strips of different thicknesses is no longer necessary. Thus, it is possible to rationalize the attachment of the furring strips.

As described above, since the bearing wall panel, which exhibits the strength as a wall of a building, is disposed on the inside of the exterior building material via the furring strips, the bearing wall panel is protected by the exterior building material against rainwater or the like, and therefore a decrease in the strength due to corrosion or the like is prevented. Accordingly, the durability of the bearing wall is improved.

As the method for constructing the wall structure according to the first aspect of the invention, in addition to the method in which the receiving members are fixed to the inner side faces enclosed by the structural members including the pillars and the horizontal members before fixing the bearing wall panel to the receiving members, there is a method as described below.

A method for constructing a bearing wall of a wall structure for a wooden building, the wall structure including a bearing wall in which receiving members are fixed to inner side faces enclosed by structural members including pillars and horizontal members of a wooden building and a bearing wall panel is fixed to an exterior side of the receiving members; a non-bearing wall; a furring strip; and an exterior building material, and a face of the bearing wall panel on the exterior side being flush with faces of the structural members on the exterior side and a face of an adjacent non-bearing wall on the exterior side, the method including:

attaching the receiving members that have been attached to the bearing wall panel beforehand to the inner side faces of the pillars or the horizontal members integrally with the bearing wall panel.

According to the above-described construction method, the receiving members are attached to the structural members in a state in which the bearing wall panel has been attached to the receiving members beforehand, and therefore the necessity of attaching the bearing wall panel to the receiving members at the construction site is eliminated. Thus, the construction time can be reduced.

Furthermore, in order to maintain the performance of the bearing wall, it is necessary to attach the bearing wall panel to the receiving members with a specified number of fixing members disposed at predetermined spacing. If the bearing wall panel is attached with a smaller number of fixing members than the specified number, it is not possible to maintain a specified wall strength factor. In construction of a bearing wall, in the case where nails are adopted as the fixing members for attaching the bearing wall panel, an enormous number of nails are used, and nailing management for maintaining the construction quality is very important. Performing this nailing management, that is, fixing the bearing wall panel to the receiving members at a factory separate from the construction site can significantly contribute to maintenance of the construction quality of the bearing wall and can also reduce the construction time.

With the above-described construction method as well, providing the vent portions in the receiving members and attaching the bearing wall panel to the receiving members with a gap between the structural members and the end portions of the bearing wall panel so as not to block the vent portions of the receiving members makes it possible to ensure good air permeability inside the constructed bearing wall.

A second aspect of the invention is a wall structure for a wooden building, the wall structure including a bearing wall, a non-bearing wall, a furring strip, and an exterior building material, wherein in the bearing wall in which a bearing wall panel is fixed to faces of structural members including pillars and horizontal members of a wooden building on an exterior side, recesses having a depth corresponding to the thickness of the bearing wall panel are formed at positions where the bearing wall panel is fixed to the structural members, and a face of the bearing wall panel on the exterior side is flush with the faces of the structural members on the exterior side and a face of an adjacent non-bearing wall on the exterior side.

According to the second aspect of the invention, the recesses having a depth corresponding to the thickness of the bearing wall panel are formed at positions where the bearing wall panel is fixed to the structural members, and the bearing wall panel is fixed to those recesses, and therefore the necessity to use the receiving members as in the first aspect of the invention is eliminated. Thus, the necessity to prepare the receiving members is eliminated, and furthermore, it is no longer necessary to fix the receiving members at the construction site. Accordingly, it is possible to streamline construction work and reduce costs.

With the wall structure that uses the bearing wall in which the bearing wall panel is fastened to the faces of the structural members on the exterior side, in the case where the bearing wall and a non-bearing wall are designed and constructed next to each other based on a design giving consideration to eccentricity, it has been necessary to attach a non-bearing wall panel having the same thickness as the bearing wall panel and having no load-bearing capacity to the non-bearing wall in order to eliminate the step or unevenness between the bearing wall and the non-bearing wall. Thus, a wasteful material cost has been generated, and also time and effort for attaching the non-bearing wall panel have been generated, resulting in more construction costs. On the other hand, in the case where all the walls are designed as bearing walls in an attempt to prevent generation of a step or unevenness between a bearing wall and a non-bearing wall, more bearing wall panels than necessary will be used, and accordingly the material cost and the construction cost will increase. Furthermore, if all the walls are designed as bearing walls, it will be difficult to maintain a specified eccentricity, and earthquake resistance will deteriorate conversely.

As described above, according to the structure of a bearing wall for a wooden building of the first aspect of the invention, a bearing wall and a non-bearing wall can be freely arranged so as to keep an optimum eccentricity, and furthermore, since there is no step or unevenness between the bearing wall and the non-bearing wall, processing of the base for eliminating the step or unevenness between the bearing wall and the non-bearing wall during attachment of an exterior building material is no longer necessary, and thus the ease of construction improves.

Furthermore, according to the construction method in which the receiving members are attached to the structural members in a state in which the bearing wall panel has been attached to the receiving members beforehand, it is possible to process the receiving members and the bearing wall panel at a place other than the construction site, and therefore the construction quality of the bearing wall is improved.

According to the structure of a bearing wall for a wooden building of the second aspect of the invention, the receiving members are not used, the bearing wall and the non-bearing wall can be arranged so as to keep an optimum eccentricity, and furthermore, a step or unevenness between the bearing wall and the non-bearing wall does not occur. Thus, processing of the base for eliminating the step or unevenness between the bearing wall and the non-bearing wall during attachment of the exterior building material is not necessary, and the ease of construction further improves.

With a bearing wall of a conventional stud wall structure, in order to inspect the condition of pillars and horizontal members, which are the most important structural members, it has been necessary to remove the bearing wall panel. However, with the bearing walls of the first and the second aspects of the invention, the bearing wall panel does not cover the structural members, and thus it is possible to inspect the framework without removing the bearing wall panel even when an inspection of the framework is performed after a long period of time has elapsed since the building was built by the timber framework construction method.

DESCRIPTION OF THE PREFERRED EMBODIMENTS

Figure 1:
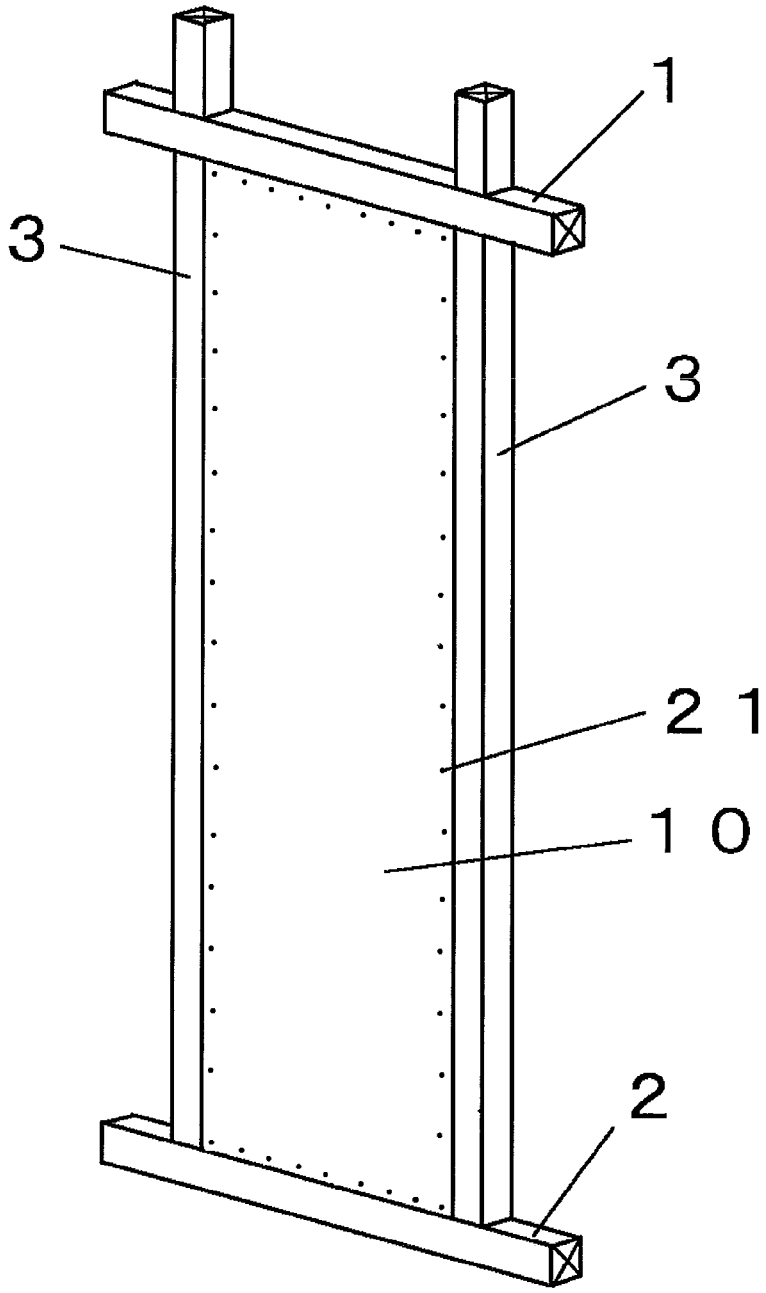
FIG. 1 is a perspective view of Embodiment 1 of the present invention.
Figure 2:
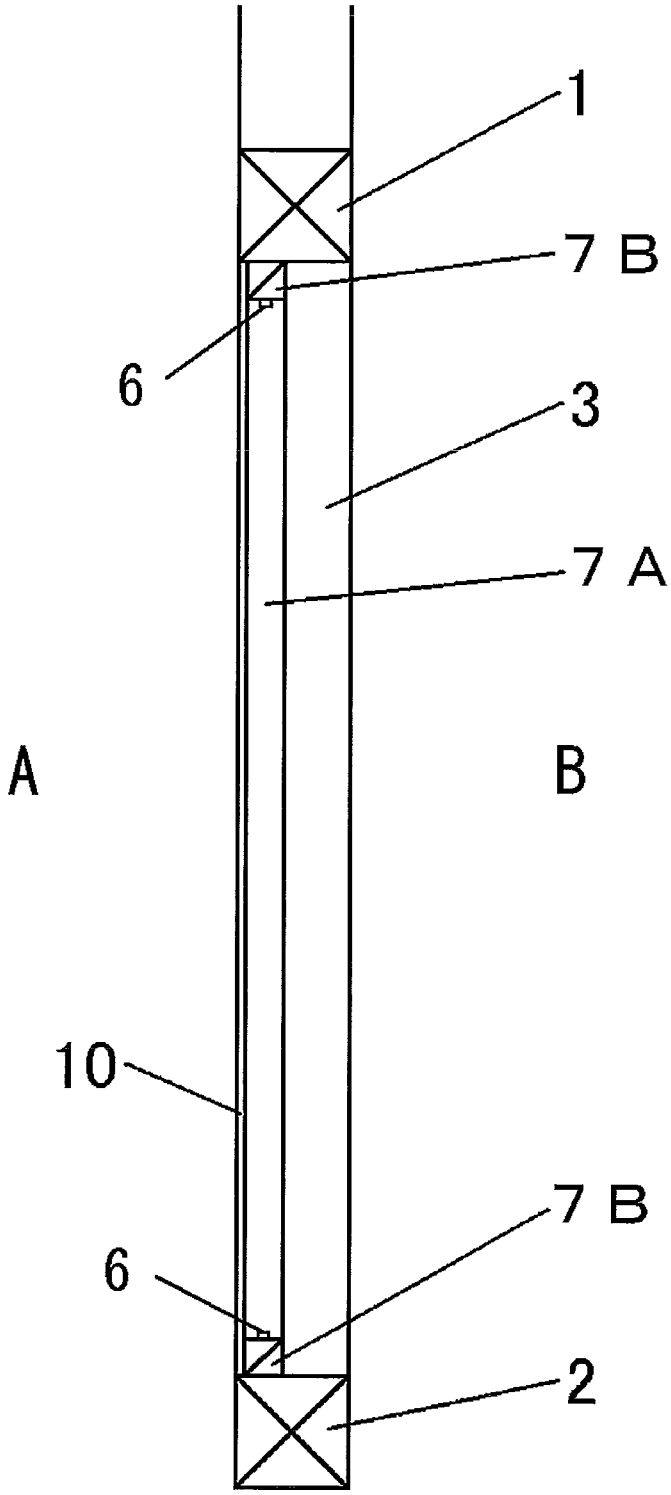
FIG. 2 is a vertical cross-sectional view of Embodiment 1 of the present invention.

Hereinafter, embodiments of the present invention will be described based on FIGS. 1 to 25.

FIGS. 1 to 4 are diagrams showing the structure of a bearing wall 31 according to Embodiment 1 of the present invention, and two mutually parallel pillars 3 extending vertically are connected to each other by a horizontal member (a girth) 1 and a horizontal member (a sill) 2 at a vertical end portion and an intermediate portion, and the pillars 3 and the horizontal members 1 and 2 all serve as structural members.

On inner side faces enclosed by the above-described pillars 3 and horizontal members 1 and 2, which serve as the structural members, receiving members 7A extending vertically, parallel to the pillars and receiving members 7B extending horizontally, parallel to the horizontal members 1 and 2 are fixed to the structural members by fixing members 6.

A bearing wall panel 10 is secured to faces of the receiving members 7A and 7B on an exterior side with nails 21, and thus the bearing wall 31 is formed. Therefore, the area of the bearing wall panel 10 is smaller than the area defined by the inner side faces enclosed by the structural members.

In order to prevent a face of the bearing wall panel 10 on the exterior side from protruding to the exterior side (the side A) from faces of the structural members on the exterior side when the bearing wall panel 10 is nailed to the receiving members 7A and 7B, the receiving members 7A are fixed with the fixing members 6 to the pillars 3, which serve as the structural members, at a position set back to an interior side (the side B) by a distance corresponding to the thickness of the bearing wall panel 10. Also, the receiving members 7B are fixed with the fixing members 6 to the horizontal members 1 and 2, which serve as the structural members, at a position set back to the interior side by the distance corresponding to the thickness of the bearing wall panel 10.

Figure 3:
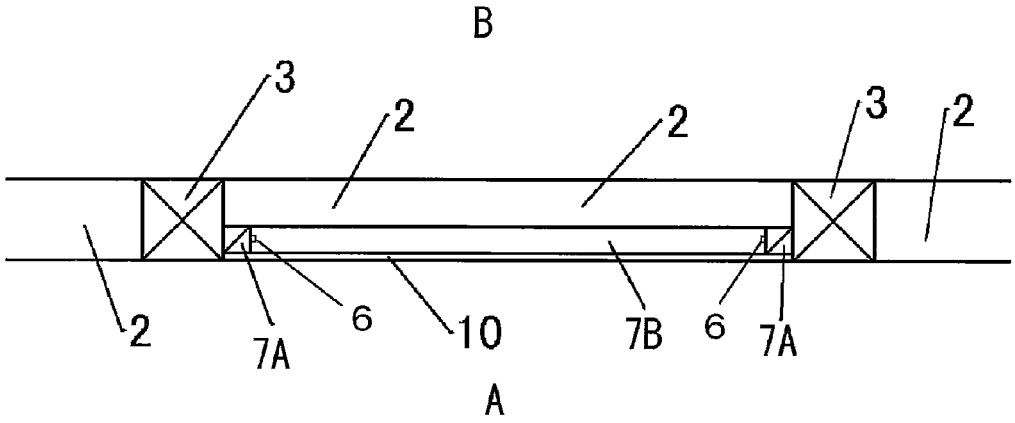
FIG. 3 is a horizontal cross-sectional view of Embodiment 1 of the present invention.

FIG. 3 is a diagram showing a horizontal cross-sectional view of the bearing wall 31 of Embodiment 1 in which the bearing wall panel 10 is nailed to the receiving members 7A and 7B.

Figure 4:
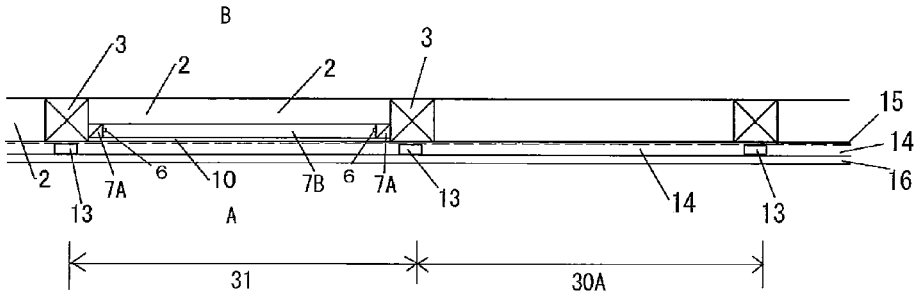
FIG. 4 is a horizontal cross-sectional view in which an exterior building material is attached in a state in which a bearing wall of Embodiment 1 of the present invention and a non-bearing wall are adjacent to each other.
Figure 5:
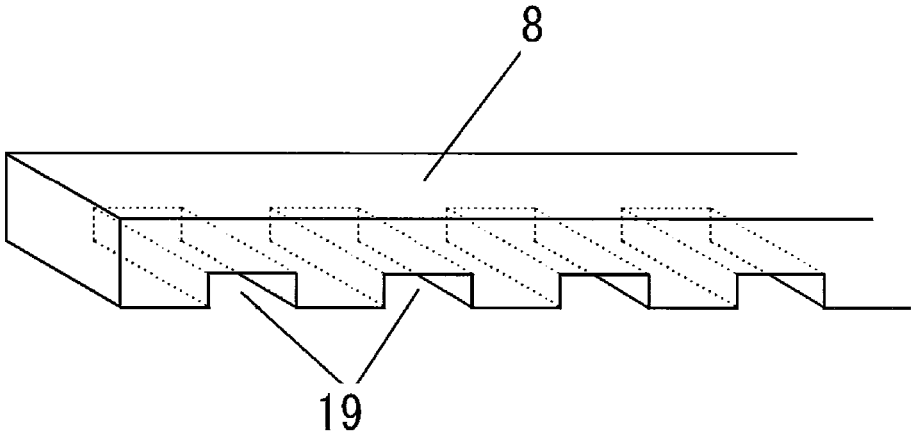
FIG. 5 shows a receiving member that is used in Embodiment 2 of the present invention and provided with vent portions penetrating the receiving member from an interior side to an exterior side.

As shown in FIG. 4, even when the bearing wall 31 of Embodiment 1 is constructed next to a non-bearing wall 30A, a face of the bearing wall 31 on the exterior side (the side A) is flush with a face of the non-bearing wall 30A on the exterior side (the side A), and accordingly the surface of a base required for exterior wall construction is flat.

Therefore, it is possible to attach waterproof paper 15 to the structural members and the bearing wall panel 10 without concerning about a step at a junction between the bearing wall 31 and the non-bearing wall 30A.

Regarding furring strips 13 that are necessary for attachment of an exterior building material 16, it is possible to use furring strips 13 of the same thickness for both the bearing wall 31 and the non-bearing wall 30A.

Therefore, it is possible to attach the exterior building material 16 without concern for the step or unevenness at the junction between the bearing wall 31 and the non-bearing wall 30A. It should be noted that the above-described non-bearing wall 30A is illustrated using a building frame of a conventional example shown in FIGS. 13 to 15.

Next, a bearing wall 31B according to Embodiment 2 of the present invention will be described with reference to FIGS. 5 to 8.

Vent portions 19 formed in a receiving member 8 is provided by forming paths penetrating an interior face and an exterior face of the receiving member 8, in order to allow airflow between the interior side and the exterior side. With respect to the shape of the vent portions 19, although rectangular grooves are formed in the present embodiment, any shape, such as arcuate notches or circular or rectangular holes, can be used as long as it enables ventilation.

Figure 6:
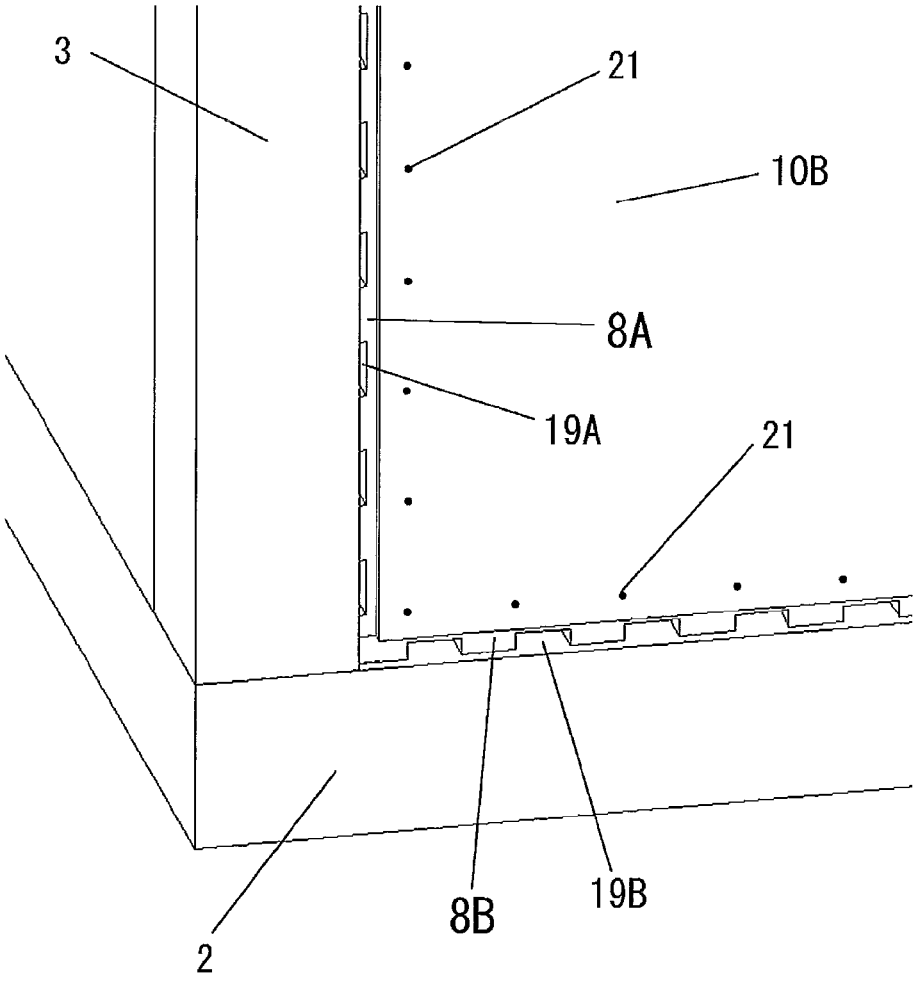
FIG. 6 is a perspective view of Embodiment 2 of the present invention in which receiving members provided with the vent portions penetrating the receiving members from the interior side to the exterior side are used and a bearing wall panel is fixed to the receiving members in such a manner that the bearing wall panel does not block the vent portions.

FIG. 6 shows vent portions 19A formed in a receiving member 8A to be attached to the pillar 3 and vent portions 19B formed in a receiving member 8B to be attached to the horizontal member 2.

A constructed state in which the receiving members 8A and 8B having the vent portions 19A and 19B have been attached will be described with reference to FIG. 6. A bearing wall panel 10B is nailed to the receiving members 8A and 8B with end portions of the bearing wall panel 10B spaced from the pillar 3 and the horizontal member 2, which serve as the structural members, so as not to block the vent portions 19A of the vertically extending receiving member 8A and the vent portions 19B of the horizontally extending receiving member 8B.

The receiving members 8A and 8B are fixed to the pillar 3 and the horizontal member 2, respectively, with fixing members 6 in such a manner that openings of the vent portions 19A and 19B are in contact with the inner side faces of the structural members. Since the openings of the vent portions 19A and 19B are in contact with the inner side faces of the pillar 3 and the horizontal member 2, which serve as the structural members, the receiving members 19A and 19B are fixed to the structural members while securing maximum areas of the vent portions 19A and 19B and minimizing the distances between the end portions of the bearing wall panel 10B and the structural members.

In Embodiment 2, similarly to Embodiment 1, in order to prevent a face of the bearing wall panel 10B on the exterior side (the side A) from protruding to the exterior side (the side A) from the faces of the structural members on the exterior side (the side A) when the bearing wall panel 10B is nailed to the receiving members 8A and 8B, the receiving members 8A and 8B are fixed, with the fixing members 6, to the horizontal member 2 and the pillar 3 at positions set back to the interior side (the side B) by a distance corresponding to the thickness of the bearing wall panel 10B.

Figure 7:
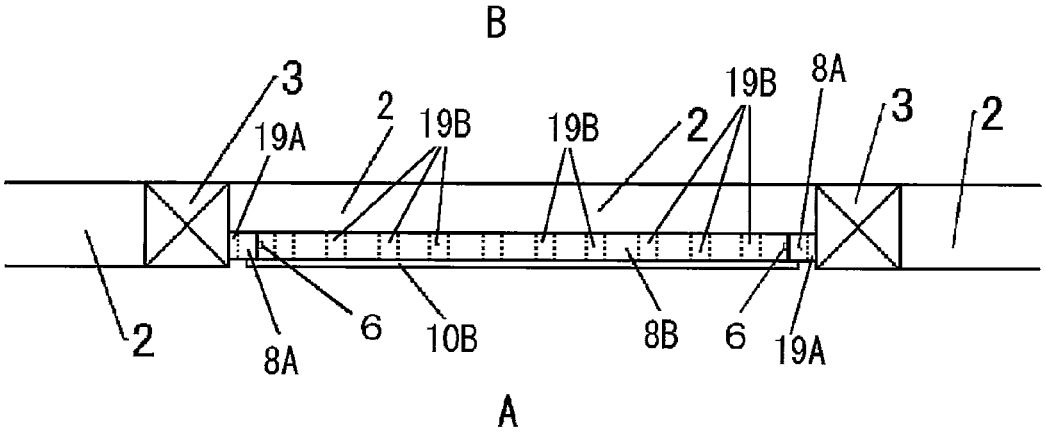
FIG. 7 is a horizontal cross-sectional view of Embodiment 2 of the present invention.

FIG. 7 is a diagram showing a horizontal cross-sectional view of the bearing wall 31B of Embodiment 2 in which the bearing wall panel 10B is nailed to the receiving members 8A and 8B having the vent portions 19A and 19B.

Figure 8:
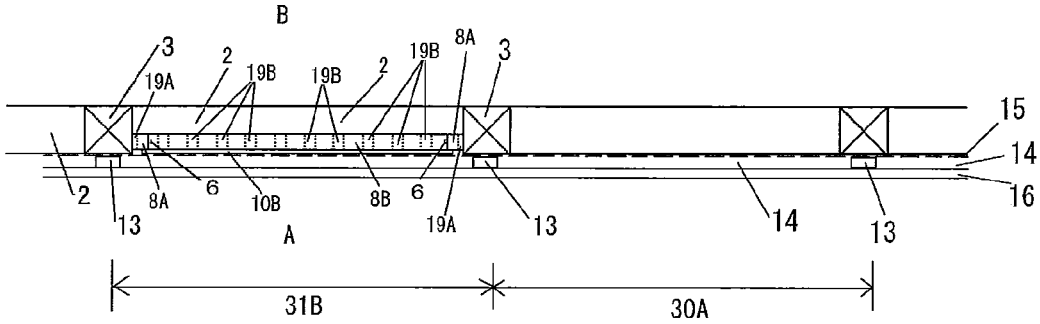
FIG. 8 is a horizontal cross-sectional view in which the exterior building material is attached in a state in which a bearing wall of Embodiment 2 of the present invention and the non-bearing wall are adjacent to each other.

As shown in FIG. 8, even when the bearing wall 31B of Embodiment 2 is constructed next to the non-bearing wall 30A, a face of the bearing wall 31B on the exterior side (the side A) is flush with the face of the non-bearing wall 30A on the exterior side (the side A), and accordingly the surface of the base for attachment of the exterior building material 16 is flat.

Therefore, it is possible to attach the waterproof paper 15 to the structural members without concerning about the step or unevenness at a junction between the bearing wall 31B and the non-bearing wall 30A.

Regarding the furring strips 13 that are necessary for attachment of the exterior building material 16, furring strips 13 of the same thickness can be used for both the bearing wall 31B and the non-bearing wall 30A.

Therefore, it is possible to attach the exterior building material 16 without concern for the step or unevenness between the bearing wall 31B and the non-bearing wall 30A. It should be noted that the above-described non-bearing wall 30A is illustrated using the building frame of the conventional examples shown in FIGS. 13 to 15.

Next, a bearing wall 31C of Embodiment 3 of the present invention will be described with reference to FIGS. 9 to 12.

Figure 9:
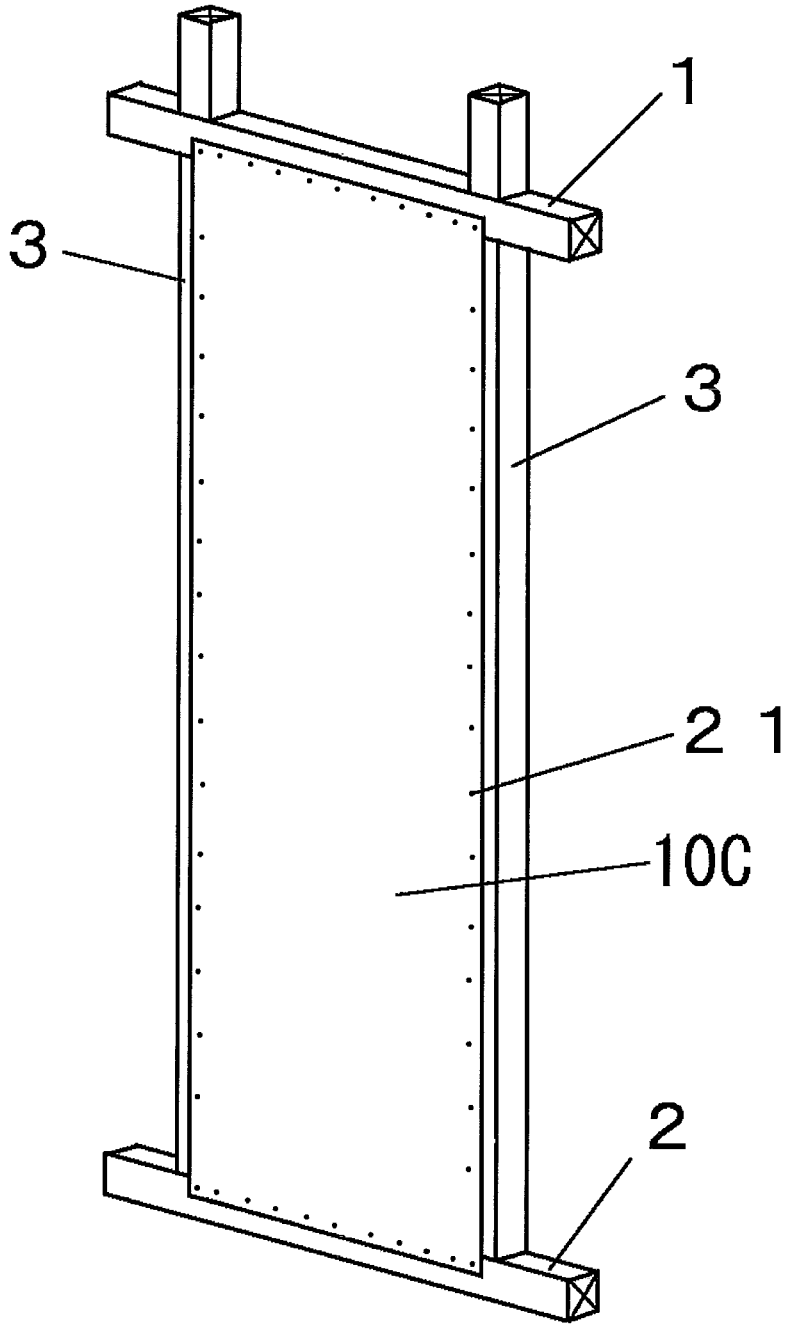
FIG. 9 is a perspective view of Embodiment 3 of the present invention.
Figure 10:
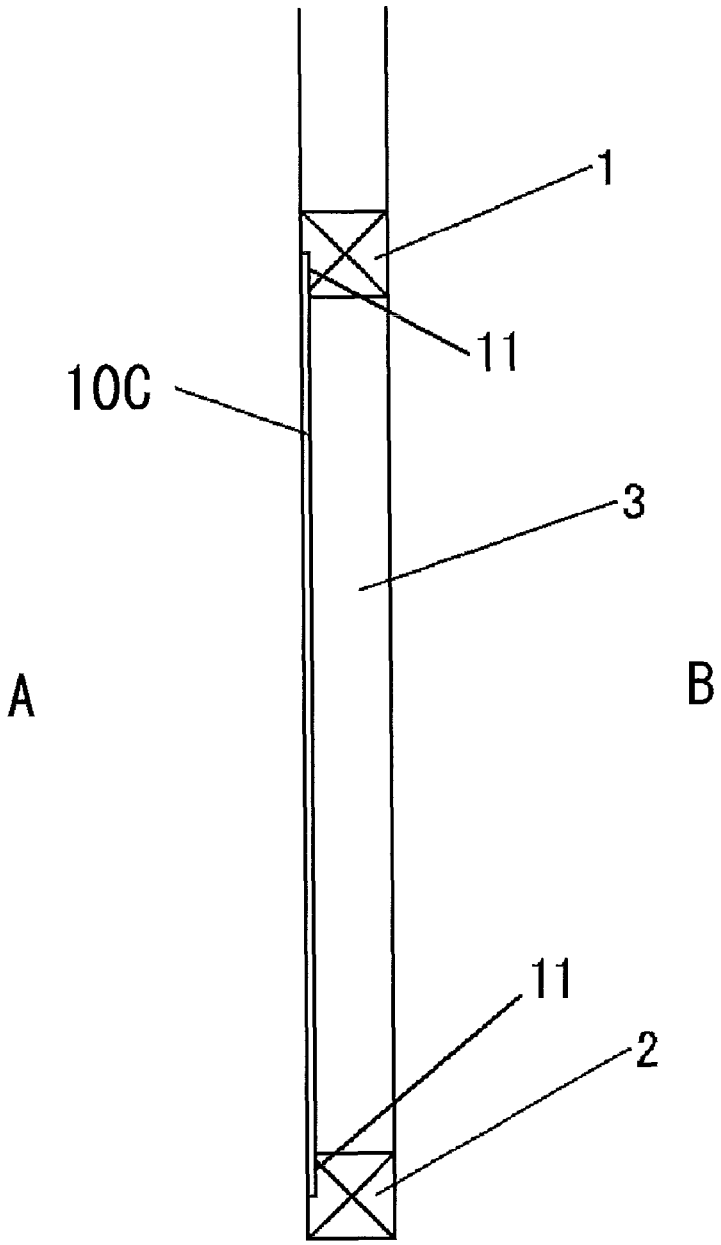
FIG. 10 is a vertical cross-sectional view of Embodiment 3 of the present invention.
Figure 11:
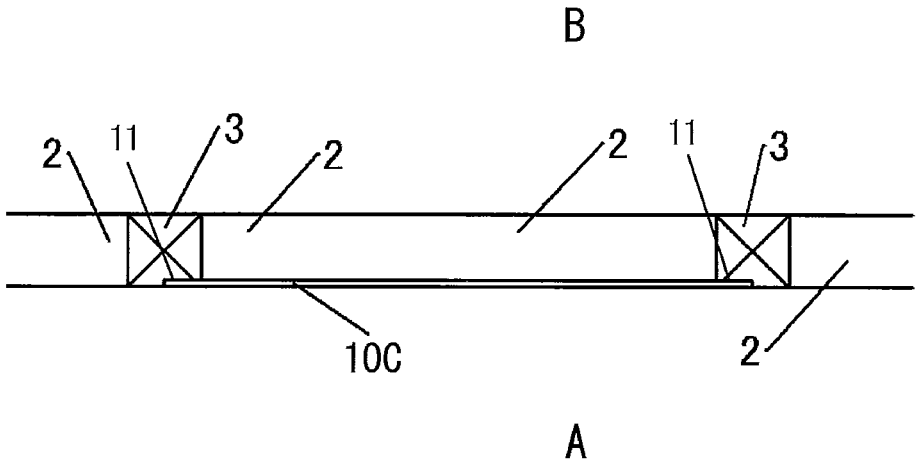
FIG. 11 is a horizontal cross-sectional view of Embodiment 3 of the present invention.

FIGS. 9 to 11 show the structure of the bearing wall 31C according to Embodiment 3 of the present invention, and the two mutually parallel pillars 3 extending vertically are connected to each other by the horizontal members 1 and 2 at a vertical end portion and an intermediate portion, and the pillars 3 and the horizontal members 1 and 2 all serve as the structural members.

A bearing wall panel 10C is fixed to the faces of the above-described pillars 3 and horizontal members 1 and 2, which serve as the structural members, on the exterior side (the side A), and thus the bearing wall 31C is formed. In the faces of the structural members on the exterior side (the side A) to which the bearing wall panel 10C is fixed, recesses 11 having a depth corresponding to the thickness of the bearing wall panel 10C are formed. Thus, when the bearing wall panel 10C is secured to the recesses 11 of the structural members with the nails 21, the face of the bearing wall panel 10C on the exterior side (the side A) does not protrude to the exterior side (the side A) from the faces of the structural members on the exterior side (the side A).

FIG. 11 is a diagram showing a horizontal cross-sectional view of the bearing wall 31C in which the bearing wall panel 10C is nailed to the pillars 3 having the recesses 11 of a depth corresponding to the thickness of the bearing wall panel 10C.

Figure 12:
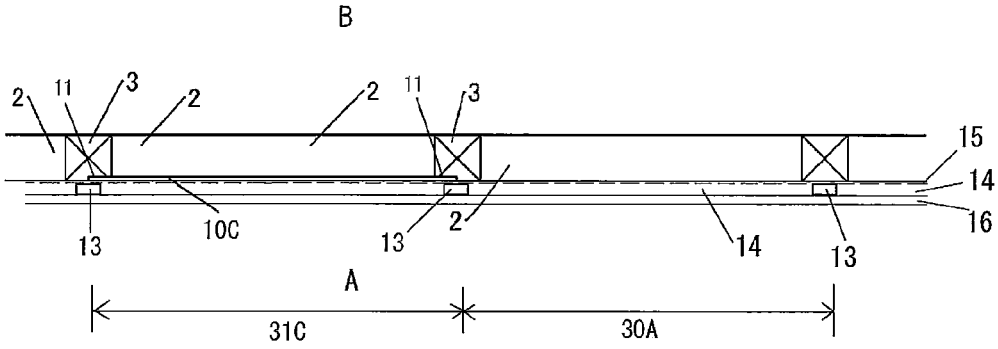
FIG. 12 is a horizontal cross-sectional view in which the exterior building material is attached in a state in which a bearing wall of Embodiment 3 of the present invention and the non-bearing wall are adjacent to each other.
Figure 13:
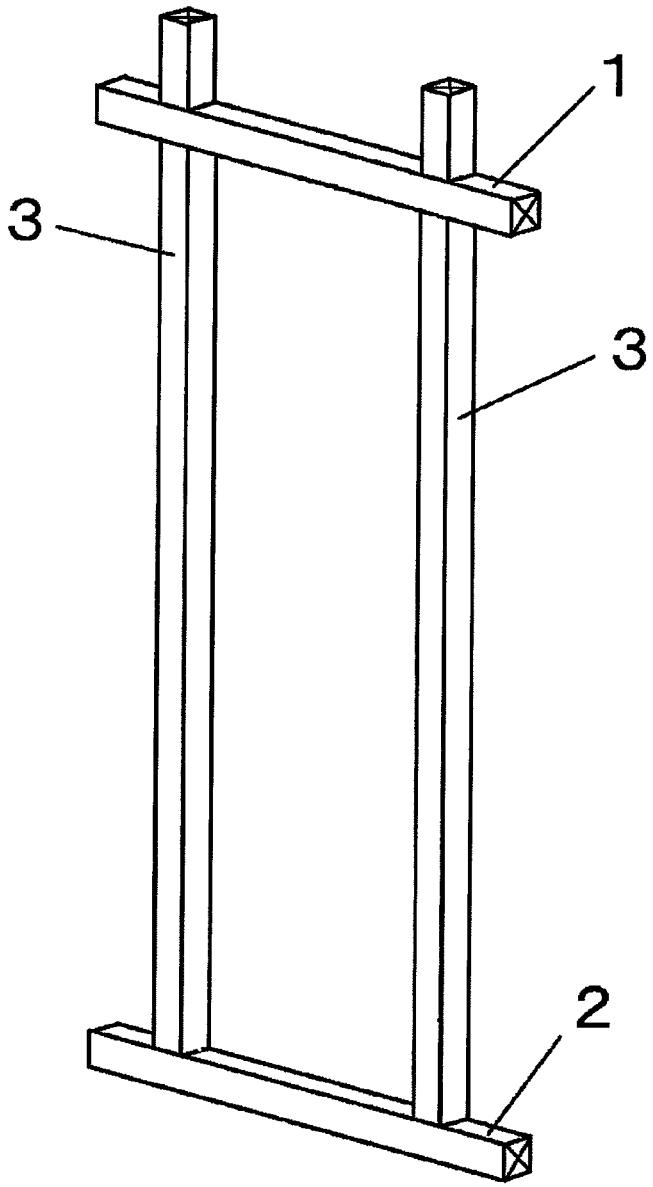
FIG. 13 is a perspective view of a building frame of a wooden building of a conventional example.
Figure 14:
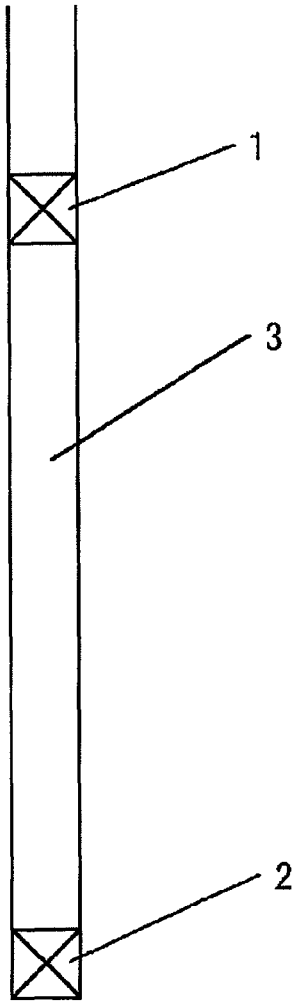
FIG. 14 is a vertical cross-sectional view of the building frame of the wooden building of the conventional example.
Figure 15:
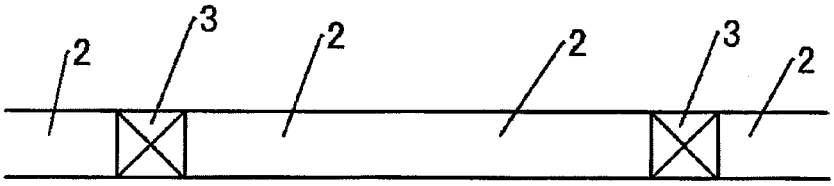
FIG. 15 is a horizontal cross-sectional view of the building frame of the wooden building of the conventional example.

As shown in FIG. 12, even when the bearing wall 31C of Embodiment 3 is constructed next to the non-bearing wall 30A, a face of the bearing wall 31C on the exterior side (the side A) is flush with the face of the non-bearing wall 30A on the exterior side (the side A), and accordingly the surface of the base required for exterior wall construction is flat.

Therefore, it is possible to attach the waterproof paper 15 to the structural members and the bearing wall panel 10C without concerning about a step or unevenness at a junction between the bearing wall 31C and the non-bearing wall 30A.

Regarding the furring strips 13 that are necessary when attaching the exterior building material 16, furring strips 13 of the same thickness can be used for both the bearing wall 31C and the non-bearing wall 30A.

Therefore, it is possible to attach the exterior building material 16 without concern for the step or unevenness at the junction between the bearing wall 31C and the non-bearing wall 30A. It should be noted that the above-described non-bearing wall 30A is illustrated using the building frame of the conventional examples shown in FIGS. 13 to 15.

Next, a bearing wall based on a stud wall structure of a conventional example will be described with reference to FIGS. 16 to 20.

Figure 16:
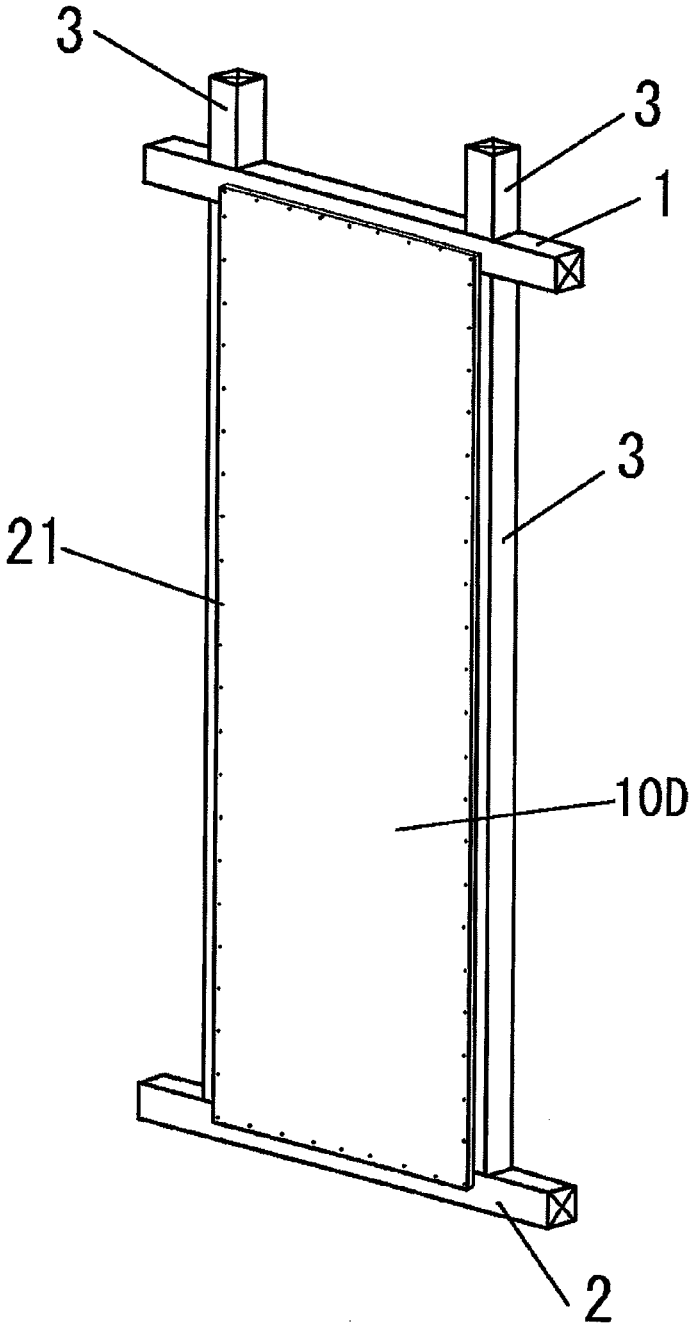
FIG. 16 is a perspective view of a bearing wall of a stud wall structure of a conventional example.
Figure 17:
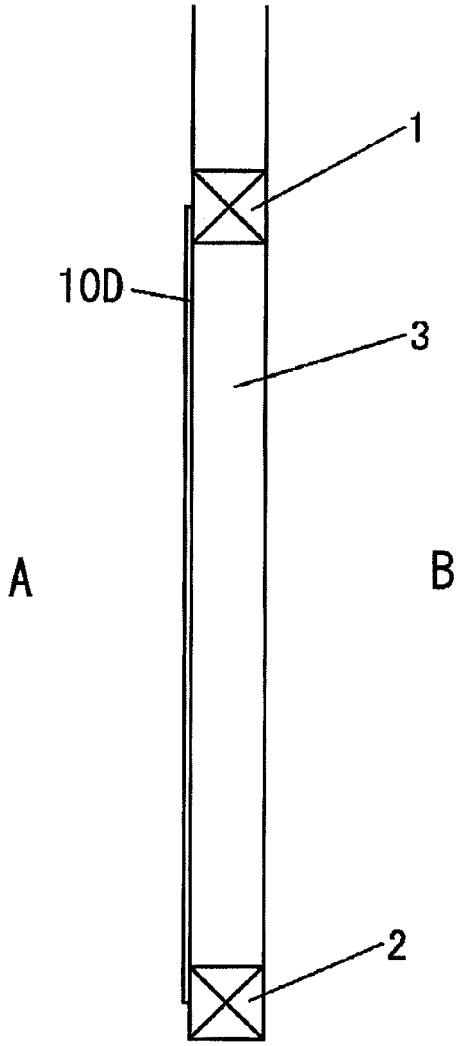
FIG. 17 is a vertical cross-sectional view of the bearing wall of the stud wall structure of the conventional example.
Figure 18:
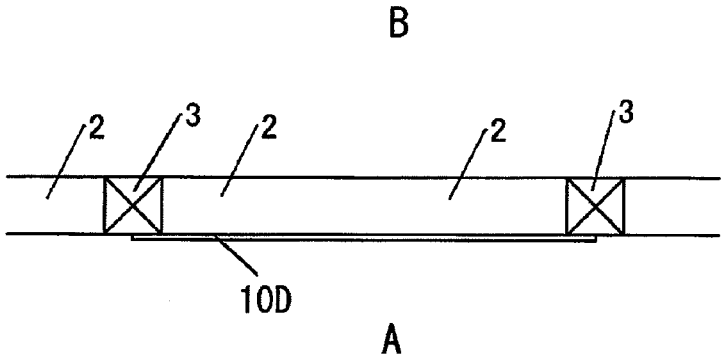
FIG. 18 is a horizontal cross-sectional view of the bearing wall of the stud wall structure of the conventional example.

FIGS. 16 to 18 show the structure of a bearing wall 31D based on a stud wall structure of a conventional example, and the two mutually parallel pillars 3 extending vertically are connected to each other by the horizontal members 1 and 2 at a vertical end portion and an intermediate portion, and the pillars 3 and the horizontal members 1 and 2 all serve as the structural members.

A bearing wall panel 10D is fixed to the faces of the above-described pillars 3 and horizontal members 1 and 2 on the exterior side (the side A), and thus the bearing wall 31D is formed. In regard to the bearing wall 31D based on the stud wall structure of the conventional example, when the bearing wall panel 10D is secured to the structural members with the nails 21, a face of the bearing wall panel 10D on the exterior side (the side A) protrudes to the exterior side (the side A) from the faces of the structural members on the exterior side (the side A) by a distance corresponding to the thickness of the bearing wall panel 10D.

Figure 19:
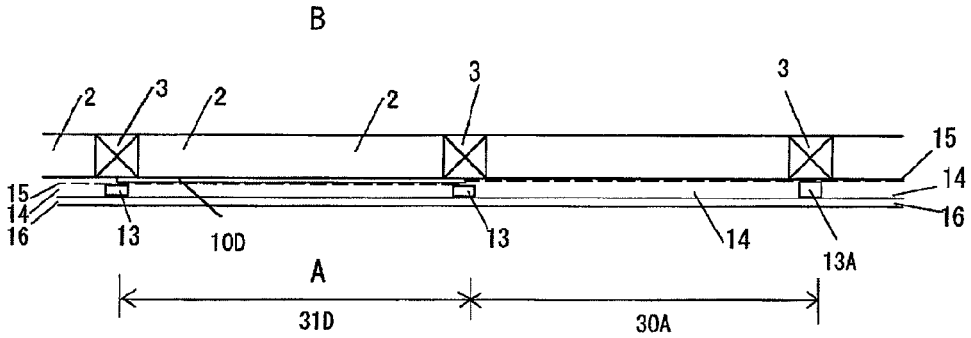
FIG. 19 is a horizontal cross-sectional view in which the exterior building material is attached in a state in which the bearing wall of the stud wall structure of the conventional example and the non-bearing wall are adjacent to each other.

FIG. 19 is a diagram showing a state in which the bearing wall 31D based on the stud wall structure of the conventional example has been constructed next to the non-bearing wall 30A composed of only a building frame.

As shown in FIG. 19, when the bearing wall 31D based on the stud wall structure of the conventional example is constructed next to the non-bearing wall 30A, a face of the bearing wall 31D on the exterior side (the side A) protrudes to the exterior side (the side A) from the face of the non-bearing wall 30A on the exterior side (the side A) by a distance corresponding to the thickness of the bearing wall panel 10D. Thus, the surface of the base for attachment of the exterior building material 16 is not flat, and a step having a height corresponding to the thickness of the bearing wall panel 10D or unevenness occurs between the bearing wall 31D and the non-bearing wall 30A.

Therefore, the waterproof paper 15 is attached in a state in which there is the step having the height corresponding to the thickness of the bearing wall panel 10D between the bearing wall 31D and the non-bearing wall 30A, and this makes it difficult to attach the waterproof paper 15. Furthermore, in regard to the attachment of the exterior building material 16, the base on which the exterior building material 16 is attached is required to be flat, and therefore it is necessary to prepare two types of furring strips having different thicknesses, that is, the furring strips 13 for bearing walls and furring strips 13A for non-bearing walls.

Therefore, it is necessary to carefully attach the waterproof paper 15, the furring strips 13 and 13A, and furthermore the exterior building material 16 with concern for the step or unevenness between the bearing wall 31D and the non-bearing wall 30A. It should be noted that the above-described non-bearing wall 30A is illustrated using the building frame of the conventional example shown in FIGS. 13 to 15.

Figure 20:
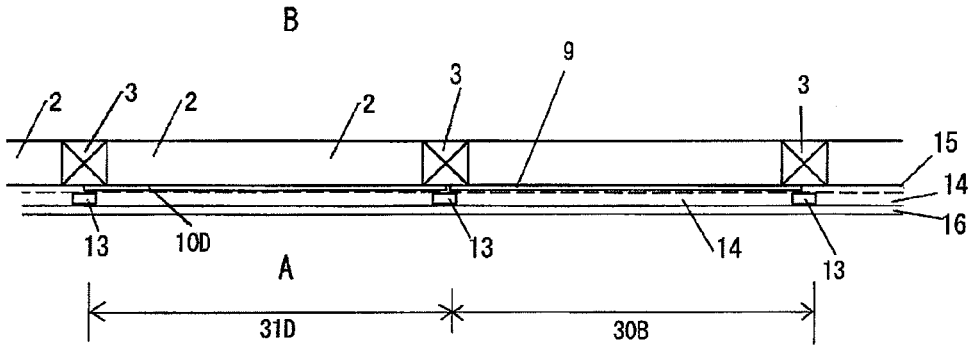
FIG. 20 is a horizontal cross-sectional view in which the exterior building material is attached in a state in which the bearing wall of the stud wall structure of the conventional example and the non-bearing wall to which a non-bearing wall panel has been fastened are adjacent to each other.

FIG. 20 is a diagram showing a state in which the bearing wall 31D of the stud wall structure of the conventional example and a non-bearing wall 30B of a stud wall structure composed of a non-bearing wall panel 9 have been constructed next to each other.

As shown in FIG. 20, if the bearing wall 31D of the stud wall structure of the conventional example is constructed next to the non-bearing wall 30B of the stud wall structure composed of the non-bearing wall panel 9, the face of the bearing wall 31D on the exterior side (the side A) is flush with the face of the non-bearing wall 30B of the stud wall structure on the exterior side (the side A), and accordingly the surface of the base for exterior wall construction is flat.

Therefore, it is possible to attach the waterproof paper 15 to the structural members without concerning about a step or unevenness at a junction between the bearing wall 31D and the non-bearing wall 30B. It is possible to use the furring strips 13 of the same thickness for both the bearing wall 31D and the non-bearing wall 30B for fastening to the structural members. However, in the case of the non-bearing wall 30B of the stud wall structure composed of the non-bearing wall panel 9, the non-bearing wall panel 9, which is not necessary under normal conditions, is used, and therefore an extra material cost is required, and furthermore, extra time and effort for construction are also required.

Next, a joint of a connecting metal fitting such as an inverted V-shaped plate 25A or a corner metal fitting 25B, which are commonly used to firmly assemble the structural members, and a bearing wall will be described.

Figure 21:
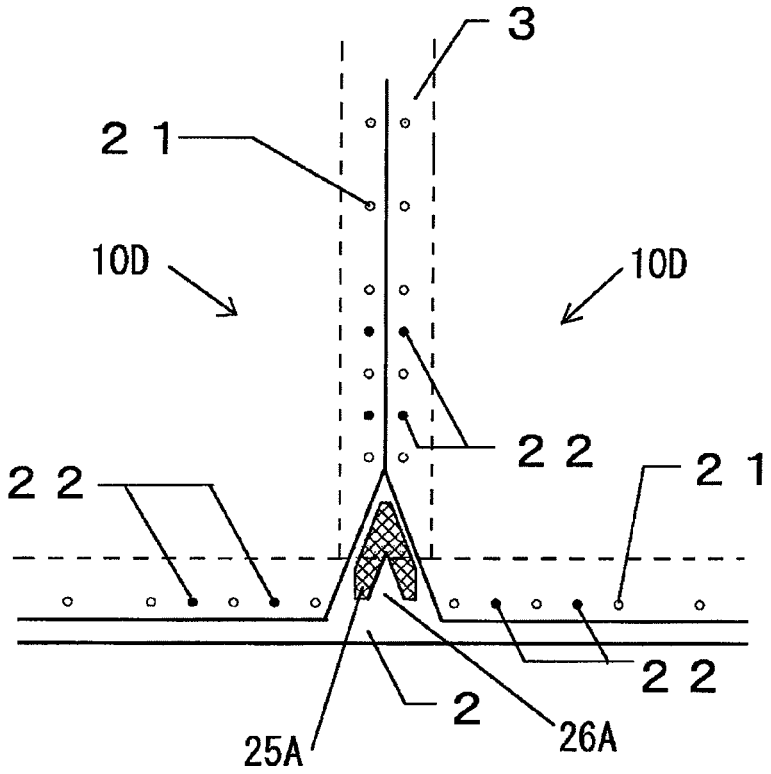
FIG. 21 is a diagram showing a joint of a connecting metal fitting (an inverted V-shaped plate) and a bearing wall panel of the bearing wall constructed by a stud wall framing finished on both side construction method of the conventional example.
Figure 23:
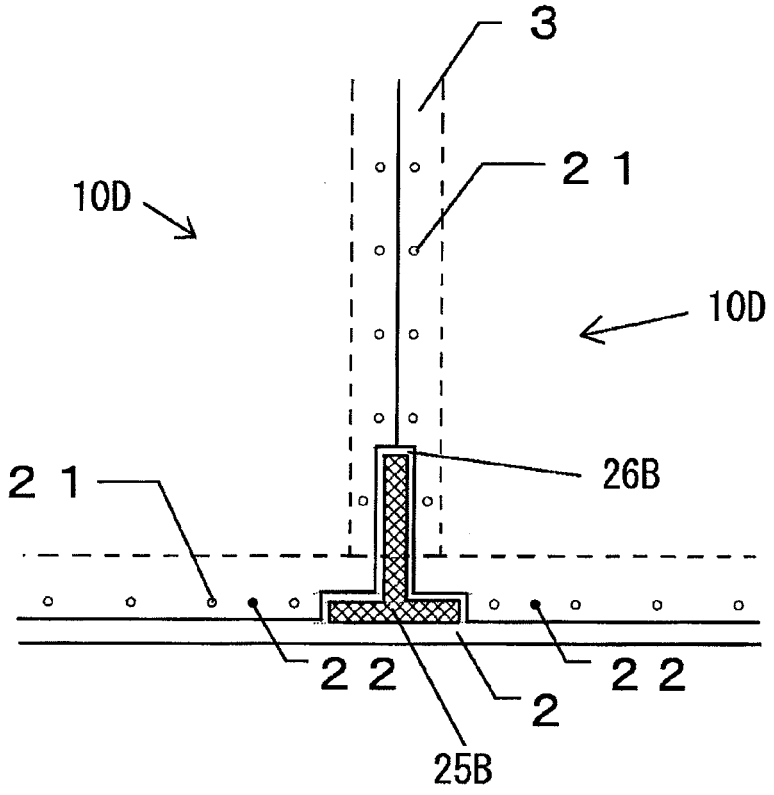
FIG. 23 is a diagram showing a joint of a connecting metal fitting (a corner metal fitting) and the bearing wall panel of the bearing wall constructed by the stud wall framing finished on both side construction method of the conventional example.

In the case of attaching the inverted V-shaped plate 25A or the corner metal fitting 25B, which are connecting metal fittings, to the bearing wall 31D of the conventional stud wall structure, as shown in FIGS. 21 and 23, in order to prevent the bearing wall panel 10D from interfering with the connecting metal fitting, it has been necessary to make a cut such as a cut 26A or a cut 26B in the bearing wall panel before attaching the bearing wall panel to the structural members.

Furthermore, forming the cut 26A or 26B in the bearing wall panel 10D makes it impossible to drive a sufficient number of nails required to maintain the performance of the bearing wall, and therefore it has been necessary that a number of additional nails 22 equal to or more than the number of nails that can no longer be driven due to the cut be additionally driven in the vicinity of the cut portion.

Figure 22:
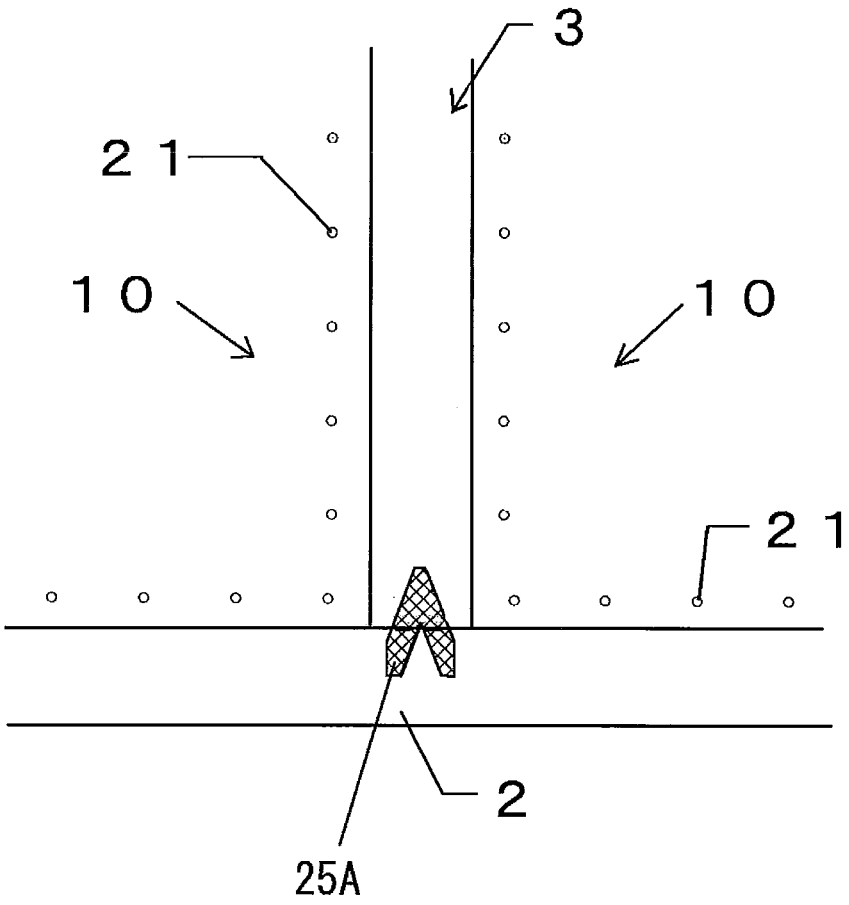
FIG. 22 is a diagram showing a joint of the connecting metal fitting (the inverted V-shaped plate) and a bearing wall panel of Embodiment 1 of the present invention.
Figure 24:
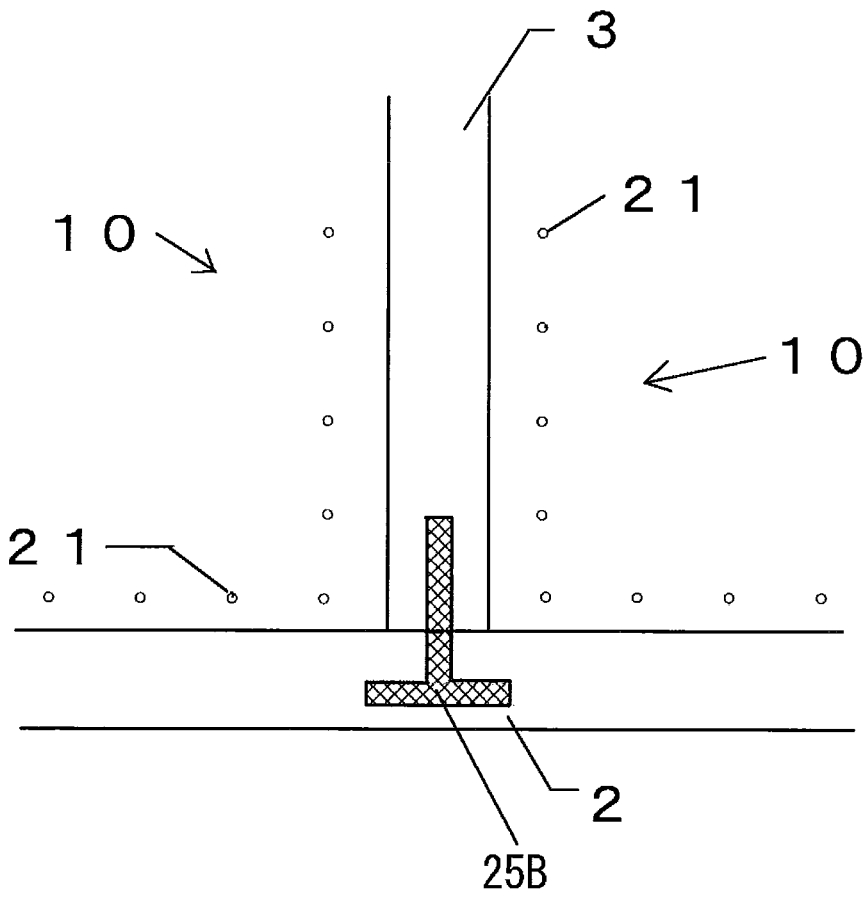
FIG. 24 is a diagram showing a joint of the connecting metal fitting (the corner metal fitting) and the bearing wall panel of Embodiment 1 of the present invention.
Figure 25:
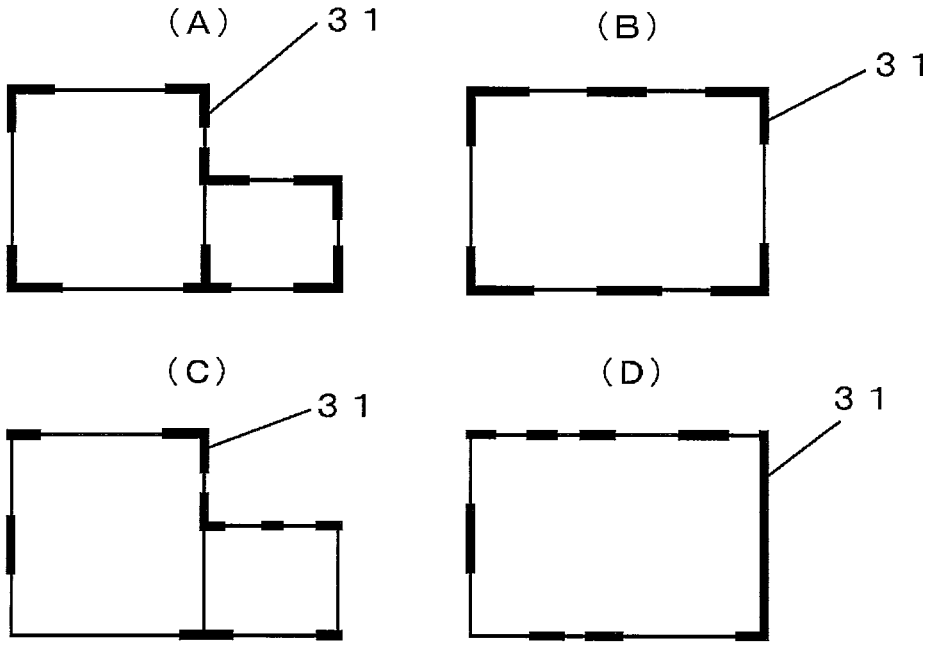
FIG. 25 shows good examples (A) (B) and bad examples (C) (D) of arrangement of bearing walls.
Figure 26:
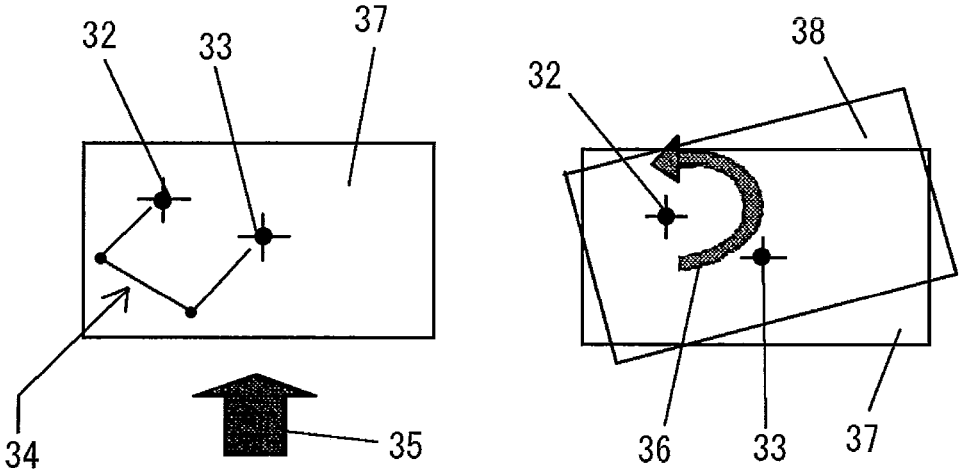
FIG. 26 is a diagram for illustrating the balance of earthquake resistance of a building.

On the other hand, according to the bearing wall of the invention disclosed in this specification, the structural members are not covered with the bearing wall panel, and the faces of the structural members on the exterior side are exposed. Thus, as shown in FIGS. 22 and 24, it is possible to attach the connecting metal fitting to the structural members of the bearing wall without the necessity to cut the bearing wall panel 10 nor to drive in the additional nails 22.

As the method for constructing the wall structure of Embodiment 1 of the present invention, it is common to use a method in which the structural members including the pillars 3 and the horizontal members 1 and 2 are assembled at a construction site, and then, after the receiving members 7A and 7B are fixed to the inner side faces enclosed by the structural members, the bearing wall panel 10 is fixed to the receiving members 7A and 7B. However, there is another construction method, which will be described below.

The bearing wall panel 10 is attached to the receiving members 7A and 7B beforehand in a factory or the like, and a resulting panel in which the bearing wall panel 10 is integral with the receiving members 7A and 7B is fixed to the inner side faces of the structural members at the construction site. This construction method eliminates the necessity of attaching the bearing wall panel 10 to the receiving members 7A and 7B at the construction site and can reduce the construction time. Furthermore, in order to maintain the performance of the bearing wall, it is necessary to drive a number of nails that is determined from the wall strength factor at specified spacing to attach the bearing wall panel 10 to the receiving members 7A and 7B. If the number of nails driven is smaller than the determined number, a prescribed wall strength factor can no longer be maintained. In construction of the bearing wall, an enormous number of nails are used to attach the bearing wall panel, and nailing management in site operation has been a very important management item in maintaining the construction quality.

Performing this nailing management, that is, fixing the bearing wall panel to the receiving members in a factory separate from the construction site can significantly contribute to the maintenance of the bearing wall quality and also enables a reduction in the construction time.

It should be noted that the above-described construction method can also be adopted in construction according to Embodiment 2 of the present invention.

Next, attachment of an exterior building material after construction of the bearing wall of the present invention will be described.

After the bearing wall panel has been fixed to the receiving members and the structural members, the waterproof paper 15 is horizontally attached to an outer side (the exterior side) of the framework. At this time, overlapping margin portions of adjacent sheets of waterproof paper 15 are superposed on top of each other and fixed. It should be noted that the positions at which superposed portions of left and right overlapping margins of the waterproof paper 15 are attached are preferably located on a pillar or a stud.

After the waterproof paper 15 has been fixed to the base, the exterior building material 16 is placed using the furring strips 13 in a state in which a space of 12 mm or more is secured on the outer side of the waterproof paper 15, thereby forming a vent layer 14, which is a space for ventilation, between the waterproof paper and the exterior building material. Moreover, an interior finishing wall is provided on an inner side (the interior side) of the framework, and an insulating material is disposed inside the interior finishing wall so as to keep the indoor temperature environment constant. Ventilation within the wall is ensured by fixing the structural members, the bearing wall panel, the waterproof paper 15, and the exterior building material 16 in this manner.

In the case where a bearing wall panel with inferior air-permeation performance is used, it is desirable to use the receiving members 8A and 8B in which the vent portions 19A and 19B are provided in order to transfer damp on the interior side to the above-described vent layer 14. Even if a bearing wall panel having poor air-permeability is used, use of the receiving members having the vent portions allows moisture in a space within the wall to be released to the exterior side (the side A) of the bearing wall through the vent portions 19A and 19B of the receiving members, to pass through the waterproof paper 15, and to be discharged outdoors through the vent layer 14, which is formed between the waterproof paper and the exterior building material. Thus, the inside of the bearing wall is always dry, corrosion and the like of the structural members can be prevented, and it is possible to increase the lifetime of the building. Moreover, although the waterproof paper 15 allows water vapor to be discharged outside the wall, it prevents movement of air and also prevents a drop of water that has intruded from the exterior wall side from intruding into the wall.

The waterproof paper used in the present invention is, for example, a sheet in which multiple small pores having a size of about several tens micrometers are formed. The waterproof paper has durability, water resistance, and corrosion resistance and has the property of not allowing large particles such as raindrops to pass through while allowing small particles such as water vapor to pass through. Therefore, the waterproof paper has air permeability as well as waterproofness and also has an insulation effect of preventing movement of air. Tyvek manufactured by DuPont can be used as an example of this waterproof paper.

In regard to the shape of the vent portions of the receiving members having the vent portions used in the present invention, any shape can be used as long as the wall and the exterior wall side are in communication with each other. Vent portions having various shapes, such as circular holes, rectangular holes, and circular arc-shaped holes, other than the vent portions as defined by a board and teeth on the bottom of the board, as introduced in Embodiment 2 of the present invention, can be still used, as long as the size and the number of the holes are such that the required strength of a receiving member of a bearing wall is not compromised.

Although embodiments of the present invention have been described above, the specific configuration of the present invention is not limited to these embodiments, and changes of design and the like that fall within the scope of the gist of the invention are also embraced by the present invention.

What is claimed is:

1. A wall structure for a wooden building, the wall structure comprising a bearing wall, a non-bearing wall, a furring strip, and an exterior building material, wherein in the bearing wall, receiving members are fixed to inner side faces enclosed by structural members comprising pillars and horizontal members of a wooden building and a bearing wall panel is fixed to an exterior side of the receiving members, a face of the bearing wall panel on the exterior side is flush with faces of the structural members on the exterior side and a face of an adjacent non-bearing wall on the exterior side, and vent portions penetrating the receiving members from an interior side to the exterior side are formed in the receiving members.

2. A wall structure for a wooden building, the wall structure comprising a bearing wall, a non-bearing wall, a furring strip, and an exterior building material, wherein in the bearing wall, receiving members are fixed to inner side faces enclosed by structural members comprising pillars and horizontal members of a wooden building and a bearing wall panel is fixed to an exterior side of the receiving members, a face of the bearing wall panel on the exterior side is flush with faces of the structural members on the exterior side and a face of an adjacent non-bearing wall on the exterior side, vent portions penetrating the receiving members from an interior side to the exterior side are formed in the receiving members, and the bearing wall panel is fixed to the receiving members with a gap between the structural members and end portions of the bearing wall panel so as not to block the vent portions of the receiving members.

3. A method for constructing a bearing wall of a wall structure for a wooden building, the wall structure comprising a bearing wall, in which receiving members are fixed to inner side faces enclosed by structural members comprising pillars and horizontal members of a wooden building and a bearing wall panel is fixed to an exterior side of the receiving members; a non-bearing wall; a furring strip; and an exterior building material, wherein a face of the bearing wall panel on the exterior side is flush with faces of the structural members on the exterior side and a face of an adjacent non-bearing wall on the exterior side, and vent portions penetrating the receiving members from an interior side to the exterior side are provided in the receiving members, the method comprising:

attaching the receiving members that have been attached to the bearing wall panel beforehand to the inner side faces of the pillars or the horizontal members integrally with the bearing wall panel.

4. A method for constructing a bearing wall of a wall structure for a wooden building, the wall structure comprising a bearing wall, in which receiving members are fixed to inner side faces enclosed by structural members comprising pillars and horizontal members of a wooden building and a bearing wall panel is fixed to an exterior side of the receiving members; a non-bearing wall; a furring strip; and an exterior building material, wherein a face of the bearing wall panel on the exterior side is flush with faces of the structural members on the exterior side and a face of an adjacent non-bearing wall on the exterior side, and vent portions penetrating the receiving members from an interior side to the exterior side are provided in the receiving members, the method comprising:

attaching the receiving members that have been attached to the bearing wall panel beforehand to the inner side faces of the pillars or the horizontal members integrally with the bearing wall panel, wherein the bearing wall panel is nailed to the receiving members with a gap between the structural members and end portions of the bearing wall panel so as not to block the vent portions of the receiving members.

* * * * *